US009010045B1

(12) United States Patent
Kopish et al.

(10) Patent No.: US 9,010,045 B1
(45) Date of Patent: Apr. 21, 2015

(54) ADD-ON WALL PANEL ARRANGEMENT FOR WALL SYSTEMS

(71) Applicant: Krueger International, Inc., Green Bay, WI (US)

(72) Inventors: Andrew J. Kopish, Green Bay, WI (US); Lon D. Seidl, Green Bay, WI (US); Tad E. Lenhart, De Pere, WI (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 14/151,905

(22) Filed: Jan. 10, 2014

(51) Int. Cl.
*E04B 2/72* (2006.01)

(52) U.S. Cl.
CPC ..... *E04B 2/721* (2013.01)

(58) Field of Classification Search
CPC ..... E06B 9/01; E06B 2009/015; E06B 9/02; E06B 3/28
USPC ..... 52/455, 456, 202, 506.05, 506.06, 29, 52/762, 769, 204.59, 204.61, 203, 208, 52/222, 800.1, 800.14, 238.1, 243, 717.03, 52/716.8; 49/50, 56–57, 61–62, 463, 466, 49/465; 160/371
See application file for complete search history.

(56) References Cited

U.S. PATENT DOCUMENTS 2,612,947 A * 10/1952 Jenks ..... 160/40
3,349,533 A * 10/1967 Gregoire ..... 52/716.8
4,320,609 A * 3/1982 Abell ..... 52/202
4,453,585 A * 6/1984 Ruggeberg et al. ..... 160/354
4,486,990 A * 12/1984 Bauch ..... 52/202
4,592,180 A * 6/1986 Gerritsen ..... 52/203
4,599,825 A * 7/1986 Sixsmith ..... 49/466
4,676,024 A * 6/1987 Rossman ..... 49/62
4,703,598 A * 11/1987 Wilson et al. ..... 52/238.1
5,253,457 A * 10/1993 Orth ..... 52/202
5,976,663 A 11/1999 Davis et al.
6,052,957 A * 4/2000 Minnich ..... 52/202
6,877,286 B2 * 4/2005 Johnson ..... 52/202
2011/0078963 A1 * 4/2011 Pardue et al. ..... 52/202
2013/0126694 A1 5/2013 Kline

* cited by examiner

*Primary Examiner* — Beth Stephan

(74) *Attorney, Agent, or Firm* — Andrus Intellectual Property Law, LLP

(57) ABSTRACT

A wall panel arrangement is adapted to be used in a wall panel system provided with at least one pair of spaced apart vertical frame members having inwardly facing sidewalls for retaining at least one existing panel therebetween. The wall panel arrangement includes an add-on wall panel assembly constructed with opposed face structure connected to opposed side structure, and adapted to cover at least a portion of the existing panel. Mounting structure is provided on the wall panel assembly, and is configured with flexible resilient retainers extending outwardly relative to the side structure, and adapted to frictionally engage the inwardly facing flat walls of the vertical frame members, and hold the wall panel assembly over the existing panel and between the vertical frame members.

12 Claims, 8 Drawing Sheets

ADD-ON WALL PANEL ARRANGEMENT FOR WALL SYSTEMS

BACKGROUND

The present disclosure relates generally to wall systems provided with at least one dedicated or existing panel installed therein. More particularly, the present disclosure pertains to an add-on wall panel arrangement which is removably and reversibly mounted to the wall system over at least a portion of the existing panel.

A wall system, such as for use in creating a workspace in an office environment, typically has a frame assembly constructed of a series of spaced apart vertical frame members connected together by horizontal frame members that extend between adjacent vertical frame members. The vertical and horizontal frame members are configured to define open areas closed by dedicated or existing wall panels retained between the frame members.

Many of today's wall systems are constructed with dedicated panels formed of a clear transparent material, such as glass, which will create a certain amount of openness in the walls of the workspace, such as for light transmission and visual communication through the clear transparent panels. However, it is important for psychological comfort and productivity to provide a degree of individual control over lighting, operator positioning and a balance between privacy and visual communication for occupants of workspaces defined by wall systems constructed of such glass panels. It is also desirable to provide a degree of customization to non-transparent dedicated or existing panels retained by frame members of existing wall systems.

Accordingly, there is a need to provide an add-on wall panel arrangement which can be easily removed and installed as well as selectively located over at least a portion of a dedicated or existing panel retained by the frame members of a wall system for ease of addressing the various changing needs of the users of these wall systems.

SUMMARY

The present disclosure relates to a wall panel arrangement adapted to be used in a wall system provided with at least one pair of spaced apart vertical frame members having inwardly facing flat walls for retaining at least one existing panel therebetween. The wall panel arrangement includes an add-on wall panel assembly constructed with opposed face structure connected to opposed side structure, and adapted to cover at least a portion of the existing panel. Mounting structure is provided on the wall panel assembly and is configured with flexible resilient retainers extending outwardly relative to the side structure, and adapted to frictionally engage the inwardly facing flat walls of the vertical frame members, and hold the wall panel assembly over the existing panel and between the vertical frame members.

The wall panel includes a shell having a horizontal wall, and a pair of spaced apart sidewalls bent away from outer ends of the horizontal wall. The wall panel has opposed faces and opposed side edges connected to the opposed faces, one of the faces being affixed to the horizontal wall of the shell and the side edges being spaced from the sidewalls of the shell. The mounting structure includes a pair of mounting strips attached to the shell and the wall panel, and is provided with the flexible resilient retainers. Each mounting strip includes a body constructed of a rigid material, and a deflectable fin forming one of the flexible resilient retainers, and extending in one direction away from the body. Each body has one side constructed with a first edge which is bent away from the body in a second direction opposite the first direction. The first edge is bent away from the body preferably at an angle less than 90°. Each body further has an opposite side constructed with a second edge bent away from the body in the second direction to form a U-shaped retaining portion defining a retaining groove. The mounting strips are slidably engaged with the shell on the wall panels such that the first edges of the mounting strips define first engagement surfaces frictionally engaged against outer ends of the horizontal wall of the shell, the second edges of the mounting strips define second engagement surfaces frictionally engaged against the side surfaces of the wall panel, and outer ends of the sidewalls of the shell are received and retained by walls forming the retaining groove of the U-shaped portion. The fins have a common longitudinal axis which lies perpendicular to the side edges, the sidewalls and the bodies of the mounting strips. The fins also have outer walls which taper inwardly towards each other as the fins extend outwardly away from the body. The second edge of each mounting strip may include a protrusion which extends beyond the U-shaped retaining portion. The fins are spaced from the side edges of the wall panel and are centered relative thereto.

The present disclosure further relates to a wall system including a frame assembly including at least one pair of spaced apart vertical frame members having inwardly facing flat walls for retaining an existing wall panel therebetween. The existing wall panel has a pair of opposed external surfaces. An add-on wall panel arrangement is configured to cover at least one portion of the existing wall panel, and is fictionally engaged between the inwardly facing flat walls of the vertical frame members. The add-on wall panel arrangement includes a shell having a horizontal wall and a pair of spaced apart sidewalls bent away from outer ends of the horizontal wall. A wall panel has a pair of opposed faces connected by a pair of opposed side edges. One of the faces is affixed to the horizontal wall of the shell, and the side edges are spaced from the sidewalls of the shell. A pair of mounting strips is attached to the shell and the wall panel, and is provided with flexible resilient retainers extending outwardly relative to the sidewalls and the side edges. The flexible resilient retainers are frictionally engaged against the inwardly facing flat walls of the vertical frame members without protruding therethrough to hold the shell and the wall panel in spaced apart relationship relative to the at least one portion of the existing wall panel and between the vertical frame members.

The existing wall panel is preferably constructed of a clear transparent material. The wall panel arrangement is configured to be removably and reversibly mounted on either or both of the external surfaces of the existing wall panel. The wall panel arrangement is further configured to be removably and reversibly mounted over either one of the external surfaces of the existing panel such that the shell attached to the one face of the wall panel lies closely adjacent the one external surface, or such that the other face of the wall panel lies closely adjacent to one external surface. Portions of the mounting strips are engaged between the shell and the existing panel. Each of the mounting strips includes a body constructed of a rigid material and a deflectable fin forming one of the flexible resilient retainers, and extending in one direction away from the body. Each body has one side constructed with a first edge which is bent away from the body in a second direction opposite the first direction. Each body further has an opposite side constructed with a second edge bent away from the body in the second direction to form a U-shaped retaining portion defining a retaining groove. The mounting strips are slidably engaged with the shell and the wall panels such that the first edges define first engagement surfaces frictionally engaged against the inwardly facing flat sidewalls of the vertical frame members, the second edges define second engagement surfaces frictionally engaged against the side edges of the wall panel, and outer ends of the sidewalls of the shell are received and retained by walls forming the retaining groove.

The present disclosure further contemplates a method of installing a wall panel arrangement in a wall system having at least one pair of spaced apart vertical frame members having inwardly facing flat walls retaining at least one existing panel therebetween. The method includes the steps of a) providing an add-on wall panel assembly constructed with opposed face structure connected to opposed side structure; b) providing the wall panel assembly with flexible resilient retainers extending outwardly relative to the side structure of the wall panel assembly to form the wall panel arrangement, the wall panel arrangement being suitably sized to be engaged between the inwardly facing flat walls of the vertical frame members, c) positioning the wall panel arrangement between the vertical frame members at a selected location such that the outwardly extending flexible resilient retainers engage the inwardly facing flat walls of the vertical frame members; and d) applying a push-on force to advance the wall panel arrangement towards the existing panel and cause deflection of the flexible resilient retainers against the inwardly facing flat walls of the vertical frame members resulting in a frictional engagement between the resilient retainers and the inwardly facing flat walls without the retainers protruding therethrough so as to hold the wall panel over at least one portion of the existing panel and between the vertical frame members.

The existing panel is constructed preferably of a clear transparent material, and the holding of the wall panel arrangement over the at least one portion of the clear transparent panel enables control of visual communication through the clear transparent panel. The wall panel arrangement is configured to be removably and reversibly engaged between the inwardly facing flat walls of the vertical frame members.

The present disclosure additionally relates to a wall panel arrangement adapted to be used in a wall system provided with at least one pair of spaced apart vertical frame members having inwardly facing flat walls for retaining at least one existing panel therebetween. The wall panel arrangement includes a shell having a horizontal wall and a pair of spaced apart sidewalls bent away from outer ends of the horizontal wall. A wall panel has opposed faces connected by opposed side edges, one of the faces being affixed to the horizontal wall of the shell, and the side edges being spaced from the sidewalls of the shell. A pair of mounting strips is attached to the shell and the wall panel, and is provided with flexible resilient retainers extending outwardly relative to the side edges and to the sidewalls, and is adapted to frictionally engage the flat walls of the vertical frame members, and hold the shell and the wall panel over the existing panel and between the vertical frame members.

BRIEF DESCRIPTION OF THE DRAWINGS

The drawings illustrate the best mode presently contemplated in carrying out the disclosure. In the drawings.

DETAILED DESCRIPTION

Figure 1:
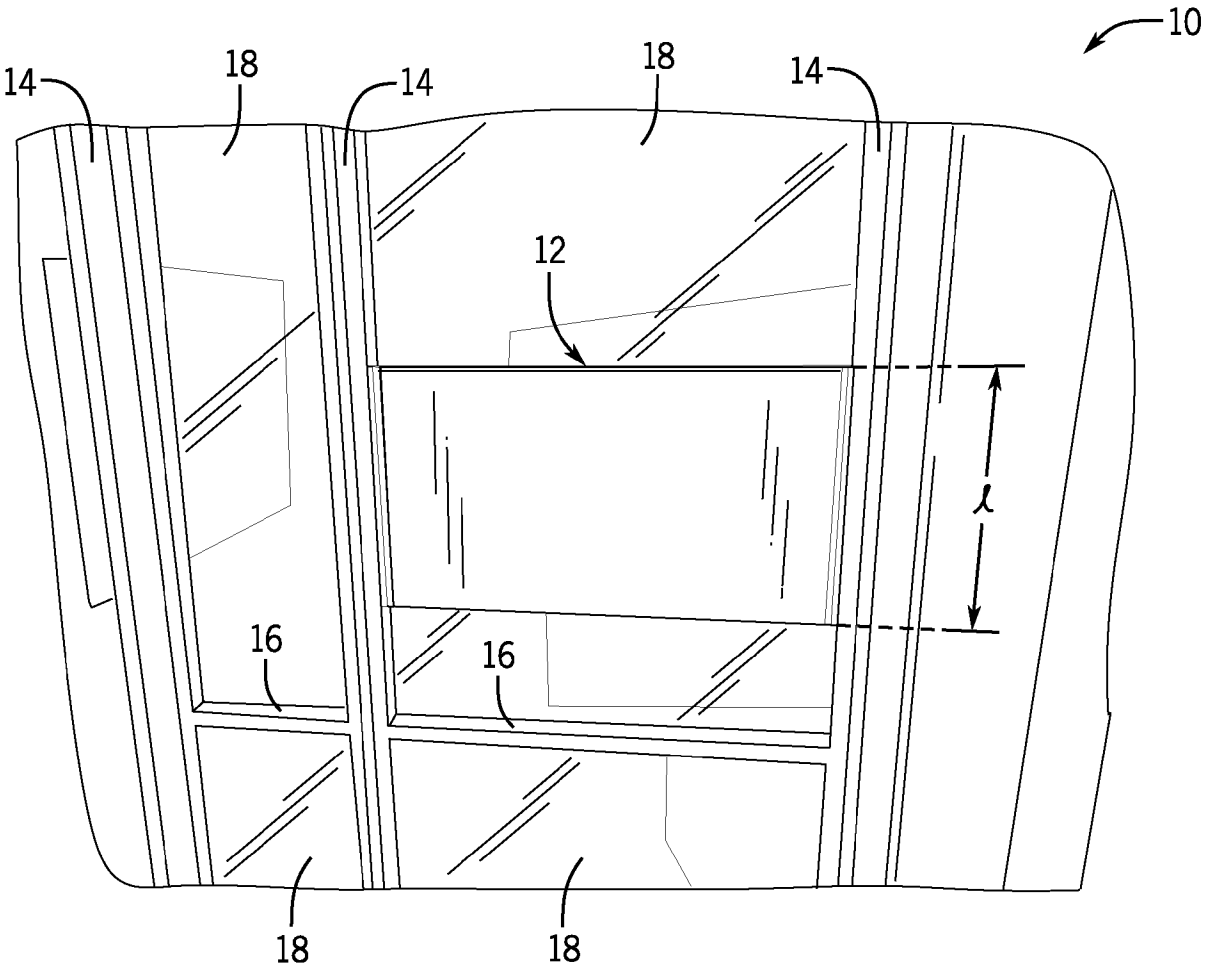
FIG. 1 is a partial front perspective view of a wall system provided with a removable and reversible add-on wall panel arrangement in accordance with the present disclosure.

Referring now to the drawings, FIGS. 1-10 illustrate a wall system 10 incorporating a removable and reversible add-on wall panel arrangement 12 in accordance with the present disclosure.

The embodiment of FIG. 1 illustrates the wall system 10 which includes a frame assembly constructed of a series of spaced apart vertical frame members 14 that are interconnected by a set of intermediate horizontal frame members 16. The frame members 14, 16 serve to support and retain a number of dedicated or existing panels 18 which are preferably shown in the form of clear, transparent, light-transmitting panels typically constructed of glass or plastic able to be seen through. As will be understood hereafter, existing panels 18 may also be formed of non-transparent panels if desired. Although not shown in FIG. 1, it should be understood that the wall system 10 normally also includes upper and lower horizontal frame members which function to further support and retain the existing transparent panels 18. Wall system 10 is typically movable and is commonly used with a number of similar wall systems 10 and related components which can be shipped to an installation site in knock down form, and then assembled on site according to a predetermined wall configuration. If desired, the wall configured can be disassembled and reconfigured to provide flexibility dividing a space and/or creating a workspace.

In accordance with the present disclosure, the wall panel arrangement 12 is removably and reversibly engaged with either the vertical frame members 14 (FIG. 1) or the horizontal frame members 16 (FIG. 10) and the transparent panel 18 retained therebetween. The removable and reversible wall panel arrangement 12 is designed to provide an add-on, interchangeable, push-on panel construction which can be selectively sized and located along the transparent panel 18. Such panel construction is particularly useful in enabling the occupant of a workspace created by the wall system 10 to control the degree of desired lighting into the workspace, and provide a balance between privacy and visual communication for the workspace occupant.

Figure 2:
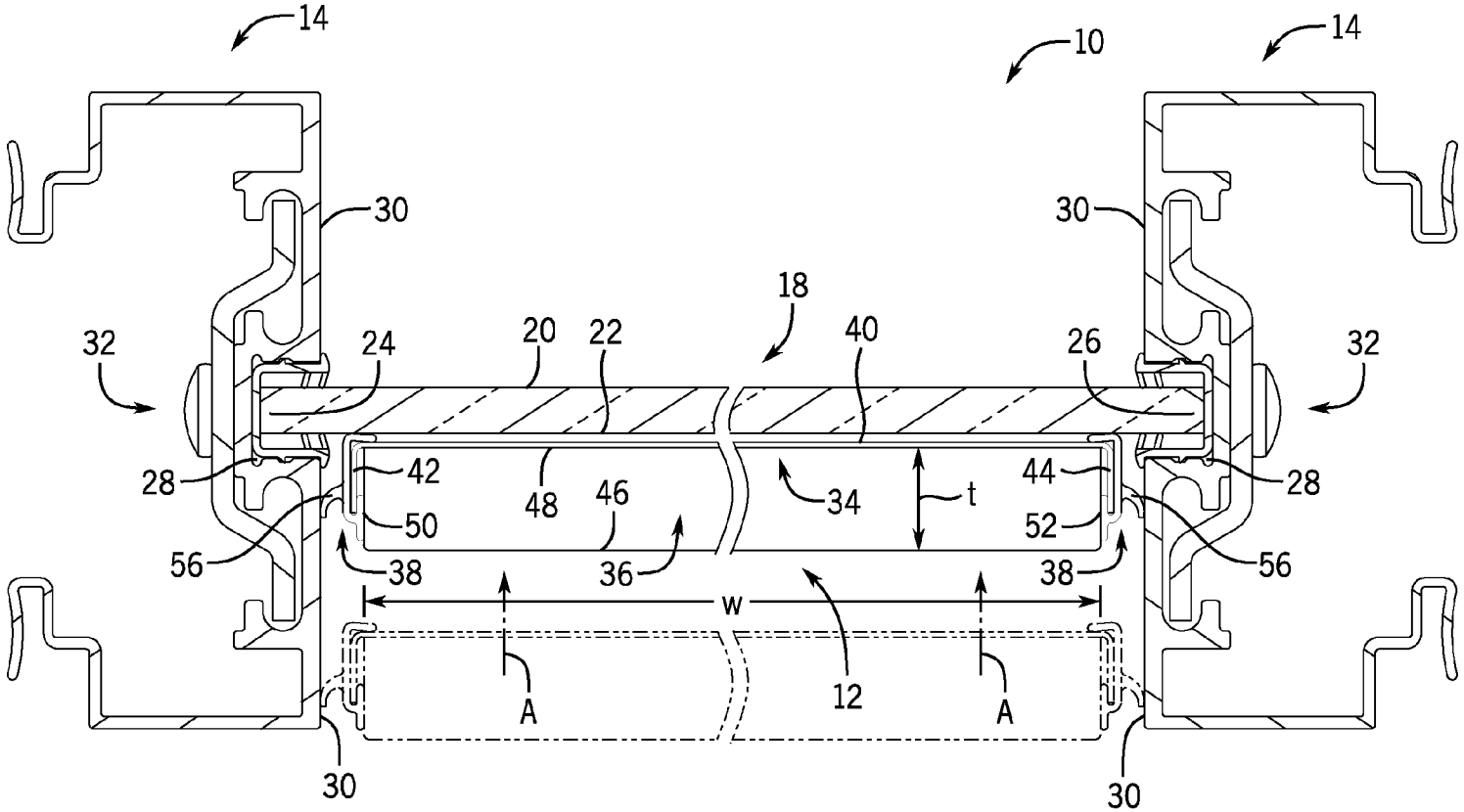
FIG. 2 is an enlarged sectional view showing the wall panel arrangement installed in the wall system of FIG. 1.
Figure 3:
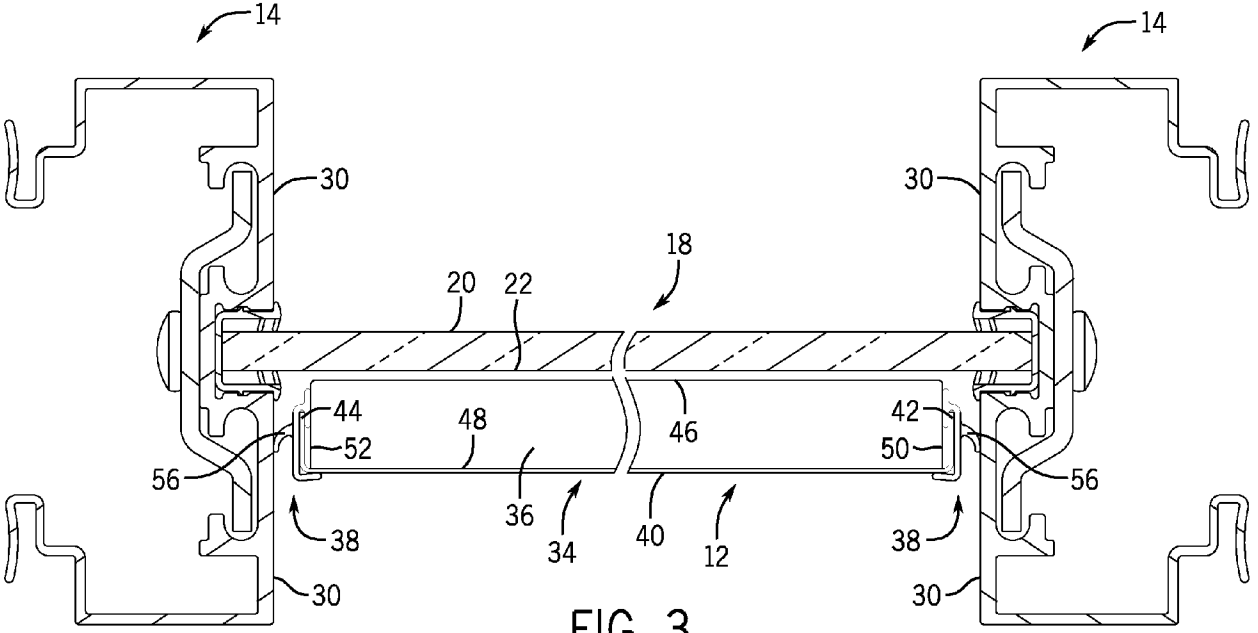
FIG. 3 is a sectional view similar to FIG. 2 showing the wall panel arrangement installed in a reverse orientation.
Figure 4:
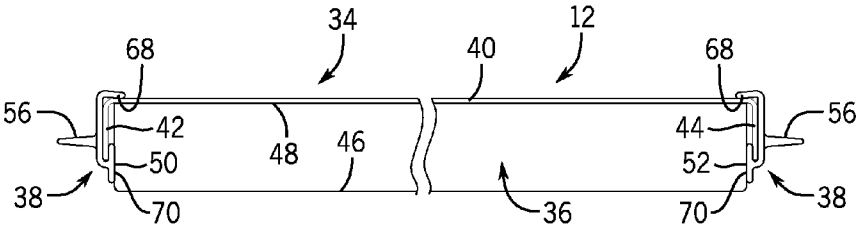
FIG. 4 is a top view of the wall panel arrangement removed from the wall system of FIG. 2.

Referring now to the embodiment shown in FIGS. 2-4, the transparent panel 18 is preferably a solid glass plate construction having opposed flat external surfaces 20, 22 and opposed side edges 24, 26. The transparent panel 18 is held in position by securing the side edges 24, 26 within recesses 28 formed in opposed inwardly facing flat walls 30 of each pair of the vertical frame members 14 using retaining assemblies 32. The vertical frame members 14 are configured to be connected with other vertical frame members 14 or other wall system components, such as a door frame member, as is well known.

The wall panel arrangement 12 is generally comprised of a metallic shell 34, a wall panel or tile 36, and a pair of identical elongated mounting strips 38 engaged with the side structure of the shell 34 and the panel 36.

The metallic shell 34 is U-shaped in cross section and includes a flat horizontal wall 40 and a pair of sidewalls 42, 44 which are bent at generally 900 angles away from the horizontal wall 40. The wall panel 36 is generally rectangular in cross section, and includes opposed horizontally extending faces 46, 48 and opposed side edges 50, 52 connected thereto. The wall panel 36 has a length 1 (FIG. 1), a width w and a thickness t as seen in FIG. 2, and may be constructed of any desired material, such as, for example a tackable material to which various items may be attached. The wall panel 36 may be constructed with a solid or hollow interior. The face 48 of the wall panel 36 is affixed to the horizontal wall 40 of the shell 34, and the side edges 50, 52 of the wall panel 36 are spaced inwardly of the sidewalls 42, 44 of the shell 34. Side edges 50, 52 are shown extending beyond outer ends of the sidewalls 42, 44. The combined width of the shell 34 and the wall panel 36 are designed to be less than the spacing between the inwardly facing flat walls 30 of the vertical frame members 14.

The mounting strips 38 are configured to be slidably engaged with the longitudinally extending shell 34 and the wall panel 36, and to be frictionally engaged against and disengaged from the flat surfaces of the walls 30 of vertical frame members 14. As best seen in the top end view of FIG. 8, each mounting strip 38 includes a body 54 fabricated from a rigid polyvinyl chloride (PVC) material, and a tapered fin 56 which extends in one direction from the body 54, and is fabricated from a flexible resilient polyvinyl chloride (PVC) material. In a preferred form, the mounting strips 38 are formed of a thermoplastic material in an extrusion process. However, it should be understood that other suitable materials and forming processes may be employed to form the mounting strips 38. The body 54 is integrally constructed on one side thereof with a flange or edge 58 which is bent at an angle less than 90° away from the body 54 in a direction opposite that of the fin 56. An opposite side of the body 54 has an edge 60 bent to the same side as the edge 58 to form a U-shaped retaining portion 62 defining a retaining groove 64. A protrusion 66 extends laterally away from the edge 60 and the U-shaped retaining portion 62. The edge 58 defines a first engagement surface 68, and the edge 60 and the protrusion 66 define a second engagement surface 70.

Referring to FIG. 4, the wall panel arrangement 12 is formed by sliding the mounting strips 38 longitudinally relative to the side structure of the shell 34 and the wall panel 36 such that the first engagement surfaces 68 frictionally engage the outer ends of horizontal wall 40, the second engagement surfaces 70 frictionally engage the side edges 50, 52 on wall panel 36 and the outer ends of the sidewalls 42, 44 are retained by the walls forming the grooves 64. When the wall panel arrangement 12 is complete, it should be appreciated that the fins 56 extend unflexed outwardly from the mounting strips 38, and are centered relative to the side edges 50, 52 of the wall panel 36 for a purpose to be appreciated below. The fins 56 of the wall panel arrangement of FIG. 4 have a common longitudinal axis which lies perpendicular to the bodies 54 of the mounting strips 38 as well as perpendicular to the sidewalls 42, 44 and the side edges 50, 52.

FIG. 2 depicts a typical installation of the wall panel arrangement 12 such as shown in the wall system 10 in FIG. 1. As seen in phantom lines, the wall panel arrangement 12 of FIG. 4 is placed between the vertical frame members 14 so that the fins 56 deflect inwardly, and are frictionally engaged with and against the inwardly facing flat walls 30. The wall panel arrangement 12 is then pushed inwardly in the direction of arrows A until the edges 58 of the mounting strips 38 engage the flat external surface 22 of the transparent panel 18. At this point, the wall panel arrangement 12 is frictionally held in position relative to the vertical frame members 14, and may be slidably moved vertically as desired to a selected location on the transparent panels 18. For example, the wall panel arrangement 12 could be selectively moved to a location which would give an occupant of a workspace seated or standing privacy by limiting the visual communication through the transparent panel 18.

In the installation of FIG. 2, it can be seen that the horizontal wall 40 of the shell 34 lies closely spaced from the external surface 22 of the transparent panel 18, and that the face 46 of the wall panel 36 is spaced furthest from the transparent panel 18. In addition, the bodies 54 of the mounting strips 38 are spaced from the walls 30 of the vertical frame members 14. However, due to the centered positioning of the fins 56 on the mounting strips 38, the wall panel arrangement 12 is configured to be reversibly mounted on the walls 30 of the vertical frame members 14 as shown in FIG. 3. In this reversible orientation, the face 46 of the wall panel 36 is closely spaced adjacent the transparent panel 18 and the horizontal wall 40 of the shell 34 is spaced at a location farthest from the transparent panel 18.

In the installation of FIGS. 2 and 3, the wall panel arrangement 12 is mounted relative to the external surface 22 of the transparent panel 18. Although not illustrated, the present disclosure envisions that the wall panel arrangement 12 may also be installed in the same manner as described above by frictionally engaging the fins 56 with the walls 30 of the vertical frame members 14 adjacent the opposite external surface 20 of the transparent panel 18. That is, the wall panel arrangement 12 is configured to be frictionally engaged and retained with vertical frame members 14 on either side or both sides of the transparent panel 18 with either the shell 34 or the wall panel face 46 lying adjacent the transparent panel 18.

Figure 5:
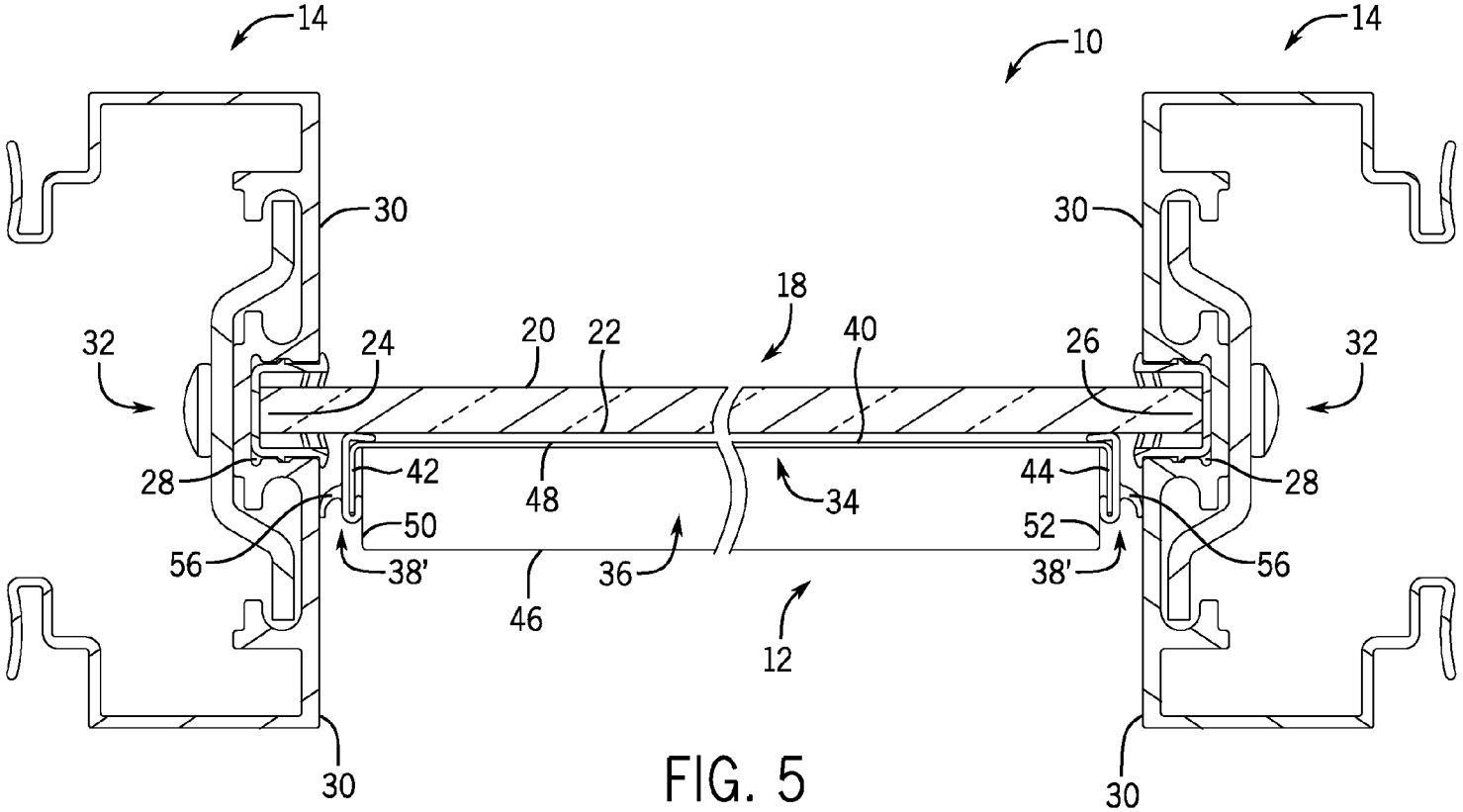
FIG. 5 is a sectional view similar to FIG. 2 showing an alternative embodiment of the wall panel arrangement installed in the wall system.
Figure 6:
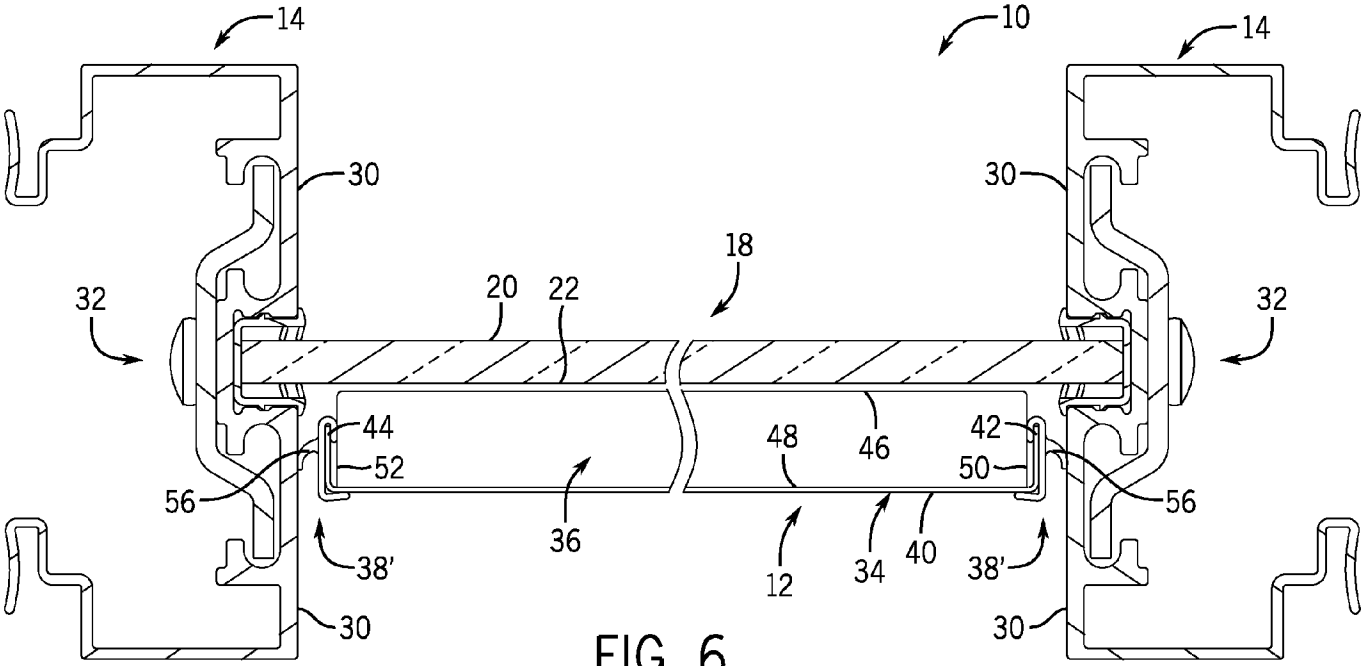
FIG. 6 is a sectional view similar to FIG. 5 showing the wall panel arrangement installed in a reverse orientation.
Figure 7:
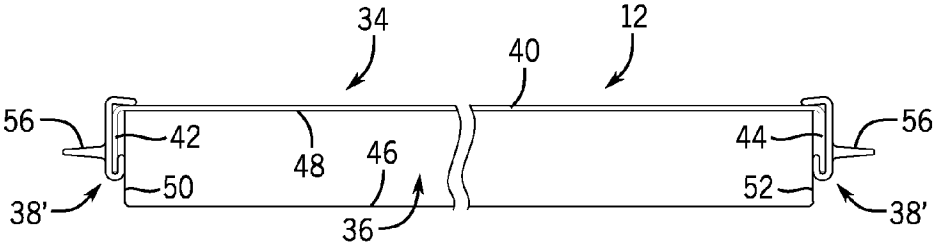
FIG. 7 is a top view of the wall panel arrangement shown removed from the wall system of FIG. 5.
Figure 9:
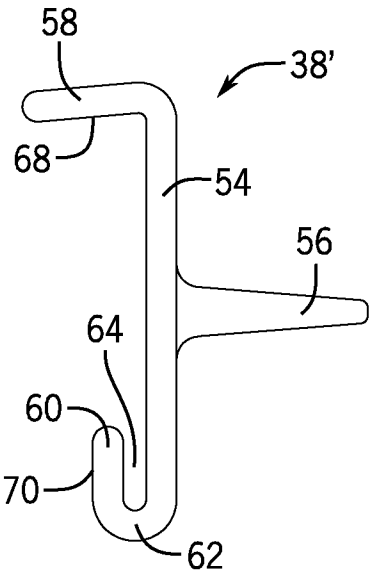
FIG. 9 is an enlarged top end view of a mounting strip used on opposed vertical side structure of a wall panel arrangement of FIG. 5.
Figure 8:
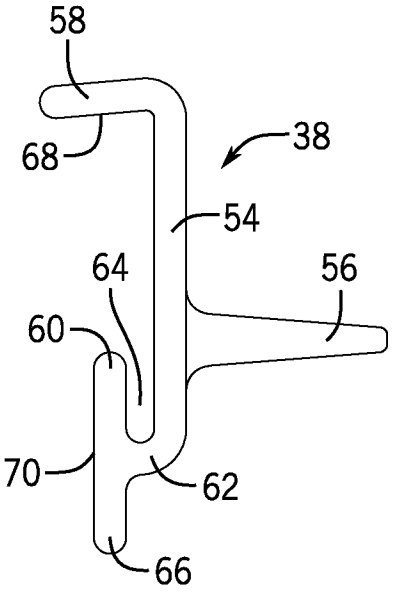
FIG. 8 is an enlarged top end view of a mounting strip used on opposed vertical side structure of the wall panel arrangement of FIG. 4.
Figure 10:
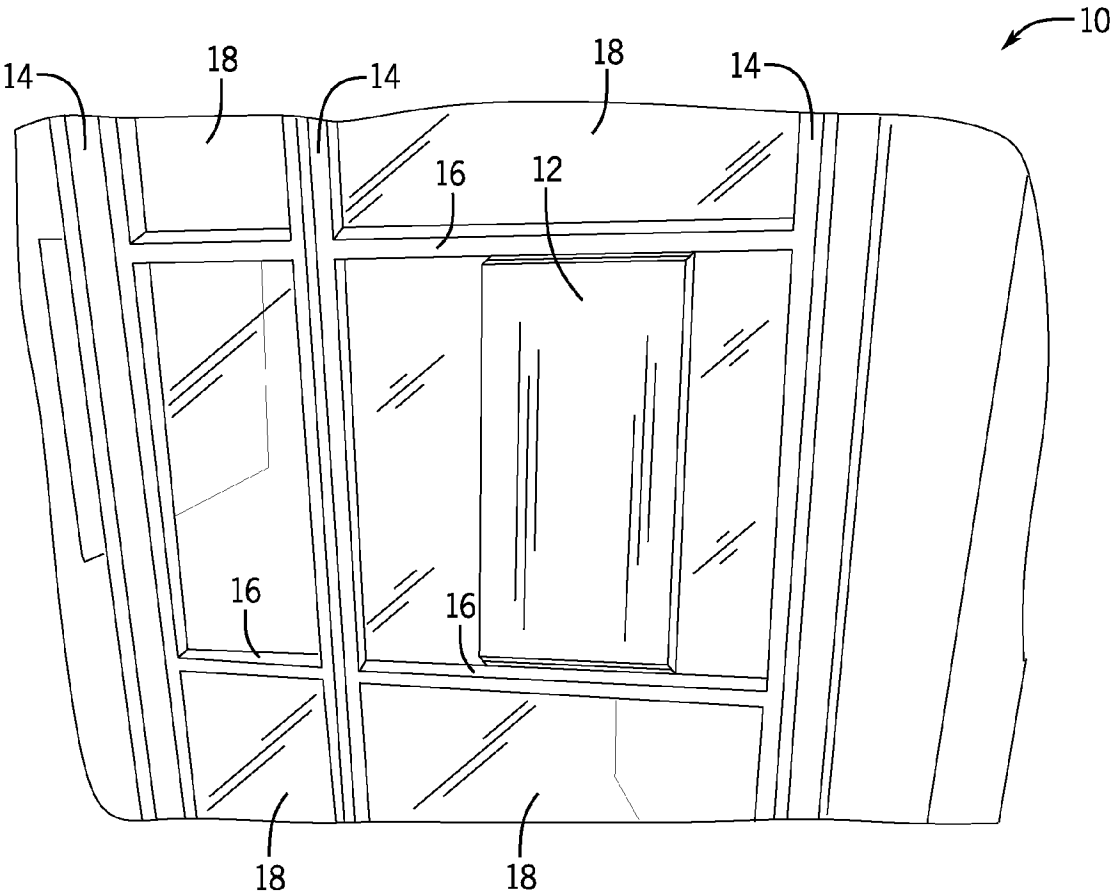
FIG. 10 is a partial front perspective view of the wall system with a removable and reversible add-on wall panel that engages horizontal frame members.

As seen in FIGS. 5, 6 and 7, the present disclosure contemplates an alternative embodiment of the wall panel arrangement 12 similar to that shown in FIGS. 2, 3, 4 and 8 except for a modified mounting strip 38' shown in FIG. 9. The mounting strip 38' is similar to the mounting strip 38 described above, but does not include the protrusion 66 so that the edge 60 by itself defines a second engagement surface 70.

The formation of the wall panel arrangement 12 and a push-on installation of the wall panel arrangement 12 utilizing mounting strips 38' is similar to the formation and installation previously detailed above with the exception that the second engagement surfaces 70 are shortened. All other aspects of the wall panel arrangement 12 shown in FIGS. 5, 6 and 7 follow those illustrated and described in FIGS. 2, 3 and 4.

Figure 11:
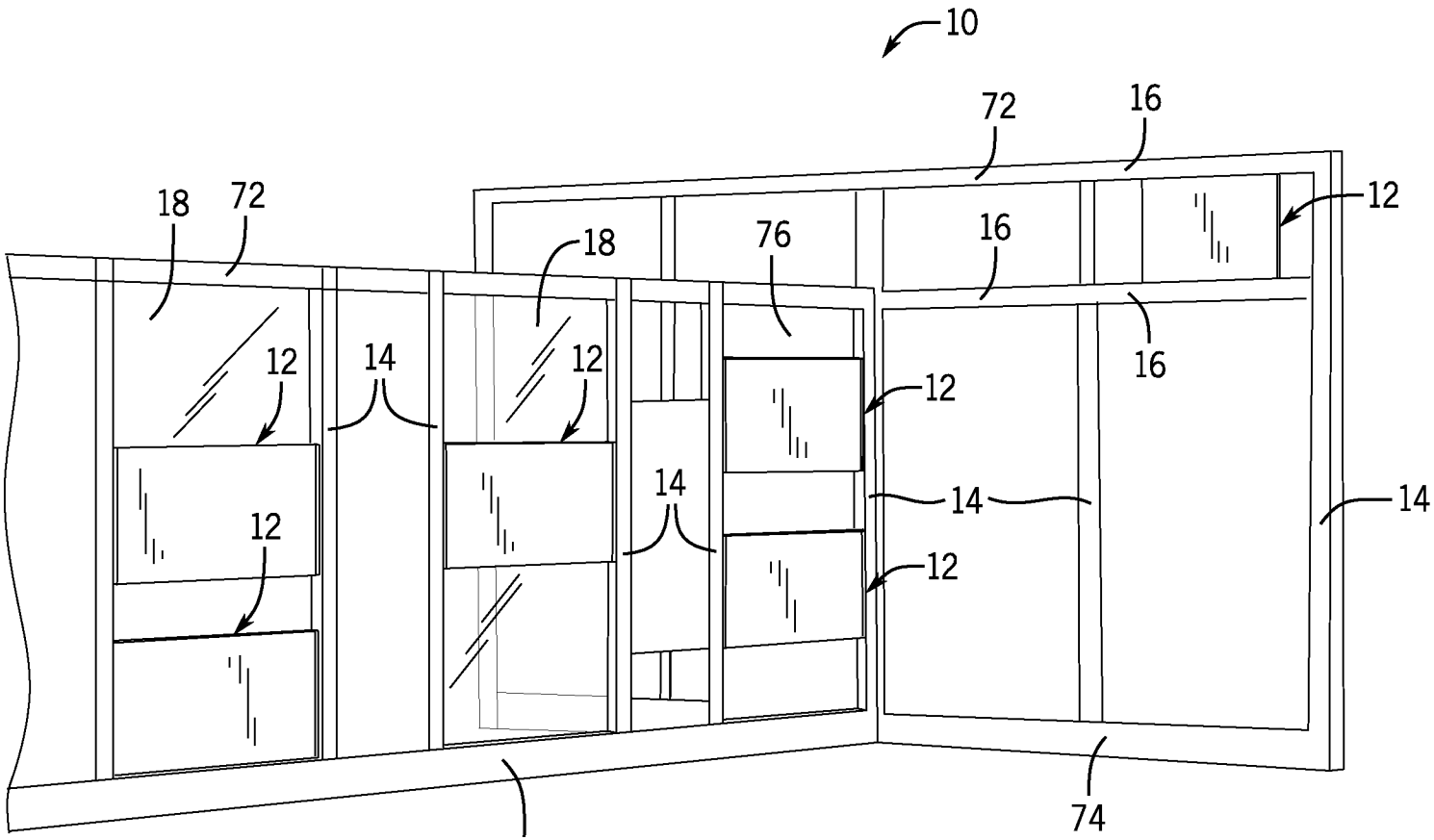
FIG. 11 is a perspective view of an exemplary installation of the wall panel arrangement positioned in various selected locations of the wall system.

FIG. 11 illustrates the push-on installation of a wall panel arrangement 12 between a pair of spaced horizontal frame members 16. In such a configuration, the top and bottom edges of the wall panel arrangement 12 include the mounting strips having the fins. The fins of the mounting strips engage the spaced horizontal frame members 16 to hold the wall panel arrangement in the location shown in FIG. 11. In this manner, the wall panel arrangement can be used in both a horizontal and vertical orientation.

FIG. 11 depicts a wall system 10 having a frame assembly constructed of a series of vertical frame members 14, intermediate horizontal frame members 16 and upper and lower horizontal frame members 72, 74 respectively. Wall panel arrangements 12 are variously sized and installed on the transparent panels 18. Other wall panel arrangements 12 may be installed on a non-transparent dedicated or existing panel 76 between vertical frame members 14 for a desired aesthetic, display or other functional effect. It is contemplated that such wall panel arrangements 12 can be reversibly mounted on either side or both sides of non-transparent wall panel 76. Certain wall panel arrangements 12 may be interchangeable with other wall panel arrangements 12 depending on certain design parameters, such as the relative size of the wall panel arrangements 12 and the spacing of the vertical frame members 14 or the horizontal frame members 16.

Unlike other wall panel installations used in previously known wall systems 10, the present wall panel arrangement 12 does not require the formation of differently sized and shaped holes and openings variously located along the vertical frame members 14 of the wall system 10. In other words, the fins 56 when engaged with the walls 30 provide a sufficient holding force to maintain the wall panel arrangement 12 in position without the need to protrude through the vertical frame members 14. Also, the wall panel arrangement 12 does not necessitate the particular alignment of various snap-in connectors on the wall panel 36 with variously formed receiving structure on the vertical frame members 14. Furthermore, no tools are required to cover the panels 18, 76 of the wall panel arrangements 12 which are quickly added to and removed from the wall system 10 by push-on and pull-off operations. In addition, no other wall systems 10 are known to provide a reversible wall panel arrangement 12 which can be easily added or interchanged on either side 20, 22 or both sides 20, 22 of an existing panel 18, 76 held between vertical frame members 14 of the wall system 10. The wall panels 36 of the wall panel arrangement 12 can be variously sized and shaped to cover at least a portion of the panel 18, 76 and, if desired, the entire surface area of the panel 18, 76.

Various alternatives and embodiments are contemplated at being within the scope of the following claims particularly pointing out and distinctly claiming the subject matter regarded as the invention.

We claim:

1. A wall panel arrangement adapted to be used in a wall system provided with at least one pair of spaced apart frame members having inwardly facing flat walls for retaining at least one existing panel therebetween, the wall panel arrangement comprising:

an add-on wall panel assembly constructed with opposed face structure connected to opposed side structure, and adapted to cover at least a portion of the existing panel, wherein the add-on wall panel assembly includes a shell having a horizontal wall and a pair of spaced apart sidewalls bent away from outer ends of the horizontal wall and a wall panel having opposed faces and opposed side edges connected to the opposed faces, one of the faces being affixed to the horizontal wall of the shell and the side edges being spaced from the sidewalls of the shell; and mounting structure provided on the wall panel assembly and configured with flexible resilient retainers extending outwardly relative to the side structure, and adapted to frictionally engage the inwardly facing flat walls of the frame members, and hold the wall panel assembly over the existing panel and between the frame members, wherein the mounting structure includes a pair of mounting strips attached to the shell and the wall panel, and provided with the flexible resilient retainers, wherein each mounting strip includes a body constructed of a rigid material, and a deflectable fin forming one of the flexible resilient retainers, and extending in a first direction away from the body, wherein each body has one side constructed with a first edge which is bent away from the body in a second direction opposite the first direction, wherein each body further has an opposite side constructed with a second edge bent away from the body in the second direction to form a U-shaped retaining portion defining a retaining groove receiving one of the sidewalls therein.

2. The wall panel arrangement of claim 1, wherein the first edge is bent away from the body at an angle less than 90°.

3. The wall panel arrangement of claim 1, wherein the mounting strips are slidably engaged with the shell and the wall panel such that the first edges of the mounting strips define first engagement surfaces frictionally engaged against outer ends of the horizontal wall of the shell, the second edges of the mounting strips define second engagement surfaces frictionally engaged against the side edges of the wall panel, and the outer ends of the sidewalls of the shell are received and retained by walls forming the retaining grooves of the U-shaped portions.

4. The wall panel arrangement of claim 1, wherein the fins have a common longitudinal axis which lies perpendicular to the side edges, the sidewalls and the bodies of the mounting strips.

5. The wall panel arrangement of claim 1, wherein the fins have outer walls which taper inwardly towards each other as the fins extend outwardly away from the body.

6. The wall panel arrangement of claim 1, wherein the second edge of each mounting strip includes a protrusion which extends beyond the U-shaped retaining portion.

7. A wall system comprising:

a frame assembly including at least one pair of spaced apart vertical frame members having inwardly facing flat walls for retaining an existing wall panel therebetween, the existing wall panel having a pair of opposed external surfaces; and an add-on wall panel arrangement configured to cover at least one portion of the existing wall panel and to be frictionally engaged between the inwardly facing flat walls of the vertical frame members, the add-on wall panel arrangement including:

a shell having a horizontal wall and a pair of spaced apart sidewalls bent away from outer ends of the horizontal wall;

a wall panel having a pair of opposed faces connected by a pair of opposed side edges, one of the faces being affixed to the horizontal wall of the shell, and the side edges being spaced from the sidewalls of the shell; and a pair of mounting strips attached to the shell and the wall panel and provided with flexible resilient retainers extending outwardly relative to the sidewalls and the side edges, the flexible resilient retainers being frictionally engaged against the inwardly facing flat walls of the vertical frame members without protruding therethrough to hold the shell and the wall panel in spaced apart relationship relative to the at least one portion of the existing wall panel and between the vertical frame members, wherein each of the mounting strips includes a body constructed of a rigid material, and a deflectable fin forming one of the flexible resilient retainers, and extending in a first direction away from the body, wherein each body has one side constructed with a first edge which is bent away from the body in a second direction opposite the first direction, wherein each body further has an opposite side constructed with a second edge bent away from the body in the second direction to form a U-shaped retaining portion defining a retaining groove receiving one of the sidewalls therein.

8. The wall system of claim 7, wherein the existing wall panel is constructed as a clear transparent material.

9. The wall system of claim 7, wherein the add-on wall panel arrangement is configured to be removably and reversibly mounted on either or both of the external surfaces of the existing wall panel.

10. The wall system of claim 7, wherein the add-on wall panel arrangement is configured to be removably and reversibly mounted on either one of the external surfaces of the existing wall panel such that the shell attached to the one face of the wall panel lies closely adjacent to one external surface, or such that the other face of the wall panel lies closely adjacent to one external surface.

11. The wall system of claim 7, wherein portions of the mounting strips are engaged between the shell and the existing wall panel.

12. The wall system of claim 7, wherein the mounting strips are slidably engaged with the shell and the wall panel such that the first edges define first engagement surfaces frictionally engaged against the inwardly facing sidewalls of the vertical frame members, the second edges define second engagement surfaces frictionally engaged against the side edges of the wall panel, and outer ends of the sidewalls of the shell are received and retained by walls forming the retaining grooves.

* * * * *